US007938106B2

(12) United States Patent
Geskes et al.

(10) Patent No.: US 7,938,106 B2
(45) Date of Patent: May 10, 2011

(54) DEVICE FOR CONTROLLING AN EXHAUST GAS STREAM

(75) Inventors: Peter Geskes, Ostfildern (DE); Hans-Peter Klein, Leutenbach (DE)

(73) Assignees: Behr GmbH & Co. KG, Stuttgart (DE); Behr Thermot-Tronik GmbH, Kornwestheim (DE)

( * ) Notice: Subject to any disclaimer, the term of this patent is extended or adjusted under 35 U.S.C. 154(b) by 549 days.

(21) Appl. No.: 12/065,683

(22) PCT Filed: Sep. 7, 2006

(86) PCT No.: PCT/DE2006/001611

§ 371 (c)(1),
(2), (4) Date: Apr. 4, 2008

(87) PCT Pub. No.: WO2007/028381

PCT Pub. Date: Mar. 15, 2007

(65) Prior Publication Data

US 2008/0250787 A1 Oct. 16, 2008

(30) Foreign Application Priority Data

Sep. 8, 2005 (DE) ..... 10 2005 044 089

(51) Int. Cl.
*F02M 25/07* (2006.01)
*F02B 47/08* (2006.01)
*F16K 11/10* (2006.01)

(52) U.S. Cl. ..... 123/568.2; 137/625.33

(58) Field of Classification Search ..... 123/568.11, 123/568.12, 568.17–568.21, 568.23–568.28; 251/129.1, 129.11, 129.15, 129.16, 319–322; 137/625.28, 625.33, 625.34, 625.36, 614.19
See application file for complete search history.

(56) References Cited

U.S. PATENT DOCUMENTS

| | | | | |
|---|---|---|---|---|
| 4,024,847 | A * | 5/1977 | Koganemaru | 123/568.2 |
| 4,048,967 | A * | 9/1977 | Stumpp | 123/568.2 |
| 6,006,732 | A * | 12/1999 | Oleksiewicz | 123/568.2 |
| 6,014,960 | A * | 1/2000 | Oleksiewicz | 123/568.2 |

(Continued)

FOREIGN PATENT DOCUMENTS

| | | |
|---|---|---|
| DE | 197 33 964 A1 | 2/1999 |
| DE | 200 02 102 U1 | 3/2000 |
| DE | 100 25 877 A1 | 12/2001 |
| DE | 101 14 249 A1 | 9/2002 |

(Continued)

*Primary Examiner* — Willis R Wolfe, Jr.
(74) *Attorney, Agent, or Firm* — Foley & Lardner LLP

(57) ABSTRACT

The invention relates to a device for controlling an exhaust gas stream. Said device comprises a housing (1, 101) with at least a first, second and third connection (2, 3, 4, 102, 103, 104) that form links to a first, second and third exhaust gas conduit for conducting the exhaust gases of an internal combustion engine, a first sliding element (6, 106) with a displaceable first sliding rod (6*a*, 106*a*) and a first sealing member (6*c*, 106*c*) that is located on said rod, a second sliding element (7, 107) with a displaceable second sliding rod (7, 107*a*) and a second sealing member (7*c*, 107*c*) that is located on said rod and an actuator for a force-assisted actuation of the device. According to the invention, a link (4*c*, 104*b*) can be established between the first and the second connection and can be adjusted by means of the first sealing member (6, 106) and a link (3*c*, 103*b*) can be established and adjusted between the first and the third connection by means of the second sealing member (7*c*, 107*c*). The device is equipped with a control mechanism (8, 108) that is connected to the actuator, said mechanism (8, 108) permitting the first sliding element (6, 106) and the second sliding element (7, 107) to be displaced.

15 Claims, 1 Drawing Sheet

U.S. PATENT DOCUMENTS

| | | | | |
|---|---|---|---|---|
| 6,039,034 | A * | 3/2000 | Field et al. | 123/568.23 |
| 6,247,461 | B1 * | 6/2001 | Smith et al. | 123/568.2 |
| 6,263,672 | B1 | 7/2001 | Roby et al. | |
| 6,279,552 | B1 * | 8/2001 | Okada et al. | 123/568.2 |
| 7,000,635 | B2 | 2/2006 | Erbe et al. | |
| 2002/0092510 | A1 * | 7/2002 | Sari et al. | 123/568.2 |

FOREIGN PATENT DOCUMENTS

| | | | |
|---|---|---|---|
| EP | 0 489 263 | A2 | 6/1992 |
| EP | 1 275 838 | A1 | 1/2003 |
| EP | 1 342 908 | A2 | 9/2003 |
| JP | 2004-257366 | A | 9/2004 |
| JP | 2005-233166 | A | 9/2005 |

* cited by examiner

DEVICE FOR CONTROLLING AN EXHAUST GAS STREAM

The present invention relates to a device for controlling an exhaust gas stream as per the preamble of claim 1.

Present demands on pollutant emissions, in particular of diesel engines, have led to the development of exhaust gas recirculation systems for internal combustion engines. Here, the recirculated exhaust gas is generally to be cooled by means of an exhaust gas cooler, with a bypass line often being arranged parallel to the exhaust gas cooler in order to ensure functionality. There is fundamentally the problem of regulating the hot and chemically aggressive exhaust gas stream both in the dosing and also in the branching to the exhaust gas cooler or bypass. For this purpose, control valves are known in which a first actuating flap carries out the dosing and a second actuating flap carries out the distribution between the cooler and bypass. For this purpose, two separate drive units are generally required for the actuating flaps.

It is an object of the invention to specify a device for controlling an exhaust gas stream which can be produced in a cost-effective manner by means of a small number of required components.

Said object is achieved according to the invention, for a device as specified in the introduction, by means of the characterizing features of claim 1.

As a result of the provision of the control mechanism with the actuator, it is made possible according to the invention for both the first slide element and also the second slide element to be adjusted, which often makes only a single actuator necessary. Here, it is preferable for in each case one of the at least three ports to be connected to an exhaust line, to an exhaust gas cooler and to an exhaust gas line of the exhaust gas cooler. The two slide elements can thus be arranged for example downstream of the exhaust gas line and distribute the exhaust gas supplied in the exhaust gas line in a dosable manner to the exhaust gas cooler and to the bypass line by means of only one actuator. Alternatively, the exhaust gas line can be arranged downstream of the bypass line and the exhaust gas cooler, which results in a relatively low exhaust gas temperature in the region of the slide elements at least in normal operation when the exhaust gas is conducted via the exhaust gas cooler.

In one preferred embodiment, at least the first slide element can be acted on with force in the closing direction by means of a spring, resulting in particularly tight closure of the closure element in the closed position.

It is also preferable for the exhaust gas stream to exert a pressure in the opening direction on at least the first closure element. In this way, the actuator and also the control mechanism can be of small construction, since only low opening forces are necessary. Alternatively, the exhaust gas stream can also act in the closing direction on the closure element.

In one particularly preferred embodiment, a further closure element which is movable with respect to the first closure element is provided on at least the first slide element, with the closure elements, during the course of an opening movement of the slide element, releasing in succession openings which are assigned to said closure elements. In this way, it is possible to obtain substantially a two-stage opening of the path of the first slide element, as a result of which particularly flexible adjustability of the exhaust gas stream is provided using simple means. It is also possible, in particular by means of suitable, for example conical shaping of the closure element, to realize good continuously variable adjustability in addition to the two-stage property. When one of the closure elements is acted on with pressure in the closing direction, it is possible by means of the two-stage opening for the required opening force to be kept low, since not the entire cross sectional area of the opening is to be released at once.

In one preferred embodiment, the control mechanism comprises at least one rotatably mounted lever in order to deflect the force of the actuator in a suitable way to the slide elements. Alternatively or in addition, the control mechanism can also comprise a rotatable shaft with an eccentric element or slotted guide disk. Said mechanical elements of the control mechanism are in each case suitable, individually or else in combination, for assigning an opening of the first slide element to a first position of the actuator and an opening of the second slide element to a second position of the actuator. Here, depending on the design of the control mechanism, there is a high degree of flexibility with regard to the selection of a suitable actuator. The actuator can thus preferably comprise a linear, in particular hydraulic drive unit, or alternatively a rotary, in particular electromotive drive unit. Fundamentally any actuator is suitable for combination with a device according to the invention. With suitable design of the control mechanism, it is possible for the actuator to be spatially arranged in such a way that the actuator is heated only to a small extent by the recirculated exhaust gas.

In one preferred embodiment of the device according to the invention, at least the first closure element is of plate-shaped design. Valve plates which provide sealing closure require only little installation space and can be produced cost effectively.

In an alternative embodiment, at least the first closure element is of conical design, as a result of which, with suitable shaping, particularly good adjustability of the opening between the relevant ports is made possible.

It is also alternatively possible for at least the first closure element to comprise a rotatable actuating flap. In general, however, it is possible to provide any design of valve closure which is suitable with regard to the temperature demands.

Further advantages and features of a device according to the invention can be gathered from the exemplary embodiments described below and from the dependent claims.

Below, two preferred exemplary embodiments of a device according to the invention are described and explained in more detail on the basis of the appended drawings.

Figure 1:
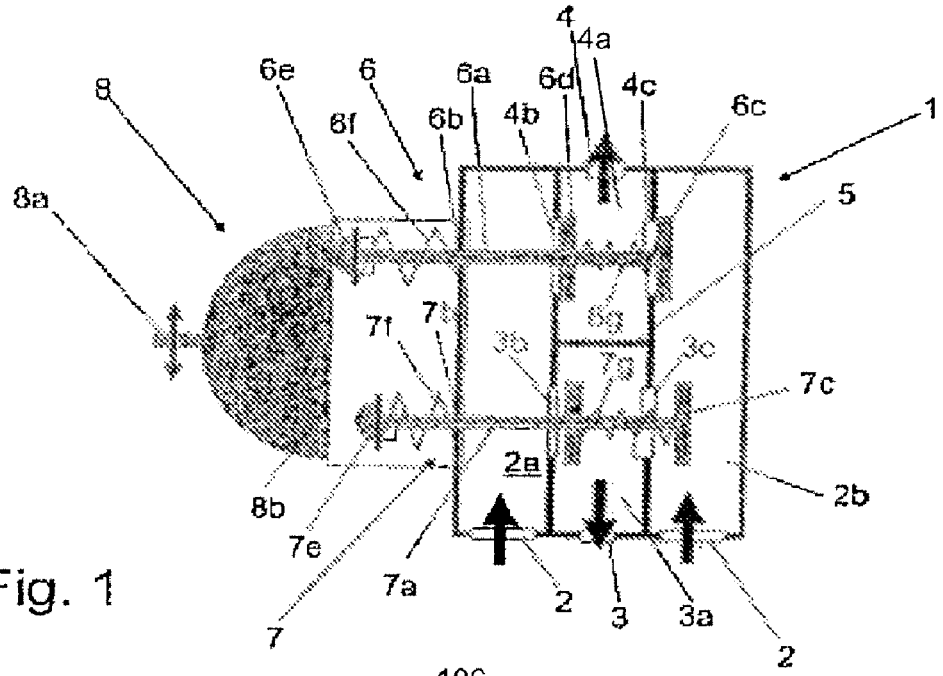
FIG. 1 shows a schematic sectioned view of a first exemplary embodiment of a device according to the invention.

The device according to the first exemplary embodiment as per FIG. 1 comprises a housing 1 with a first port 2, a second port 3 and a third port 4. The first port 2 is, according to the drawing, duly of two-part design, but is connected by means of a suitable branch (not illustrated) to the same exhaust gas duct for the supply of exhaust gas of an internal combustion engine. The two chambers 2*a*, 2*b* which, as per the schematic sectioned illustration, are separate, of the housing 1 are therefore acted on substantially with the same exhaust gas pressure.

Provided between the chambers 2*a*, 2*b* is a chamber 3*a* which is connected to the port 3 and a chamber 4*a* which is connected to the port 4, with a wall 5 separating the chambers 3*a*, 4*a* from one another. The chamber 3*a* has a connection 3*b* to the chamber 2*a* of the port 2 and a connection 3*c* to the chamber 2*b* of the port 2. The chamber 4*a* has a connection 4*b* to the chamber 2*a* of the port 2 and a connection 4*c* to the chamber 2*b* of the port 2. The connections 4*b*, 4*c* and the connections 3*b*, 3*c* lie in each case in pairs on a common axis.

A first slide element 6 is arranged along the connection axis of the connections 4*b*, 4*c*. Said slide element 6 comprises a slide rod 6*a* which is movable in a translatory fashion in its longitudinal direction and which is slidingly guided in a substantially sealing fashion at an outer aperture 6*b* of the housing 1. Situated at one end of the slide rod 6*a* is a closure element which is connected to the valve rod 6*a* and which is embodied as a valve plate 6*c* which can bear sealingly against the connection 4*c*. A second valve plate 6*d* is slidingly mounted on the slide rod 6*a* and is supported against the first valve plate 6*c* by means of a spring element 6*g*. At the other end of the slide rod 6*a*, the latter has a sliding piece 6*e*, with a spring 6*f* being supported between the wall of the chamber 2*a* and the sliding piece 6*e*.

The spring 6*f* acts, according to the illustration as per FIG. 1, on the first slide element 6 with a force directed to the left. In the illustrated closed position of the first slide element 6, the second valve plate 6*d* is pressed by the spring 6*g* sealingly against the connection 4*b*, so that the spring 6*g* exerts a force which, with respect to the support against the housing 1, acts counter to the spring 6*f*. The spring 6*f* is stronger than the spring 6*g*, so that the summed spring forces hold the two valve plates 6*c*, 6*d* in the closed position.

Arranged parallel to the first slide element 6 is a second slide element 7 which is of identical construction to the first slide element 6, so that the components of said second slide element 7 have corresponding reference symbols 7*a* to 7*g*. The second slide element 7 is arranged on the axis of the connections 3*b*, 3*c*, so that its valve plates 7*c*, 7*d* are arranged for the closure of the connections 3*c*, 3*b*. In contrast to the first slide element 6, the second slide element 7 is illustrated in a fully-open position, which can be seen from the position of the slide rod 7*a* moved to the right. Here, as can be seen, the first valve plate 7*c* of the second slide element 7 has a greater spacing from the opening 3*c* assigned to it than the second valve plate 7*d* has from the opening 3*b* assigned to it. This results in a two-stage property of the opening process, wherein when the respective slide element 6, 7 is pressed in counter to the force of the spring 6*f*, 7*f*, an opening of the end-side, fixed valve plate 6*c*, 7*c* is firstly brought about. During the course of said first opening section, the spring 6*g*, 7*g* between the valve plates is gradually relaxed until the second valve plate 6*d*, 7*d* is likewise positively moved in the opening direction by means of a driver (not illustrated) of the valve rod 6*a*. It is possible by means of said two-stage property of the opening to bring about particularly well-defined dosing of the recirculated exhaust gas stream.

A control mechanism 8 comprises a rotatably mounted lever 8*a*, with the center of rotation being positionally fixed with respect to the housing 1.

The rotatably mounted lever 8*a* is shaped such that, during its movement in one direction, a sliding face 8*b* of the lever 8*a* interacts with the sliding cam 6*e* of the first slide element and, during a deflection in the opposite direction, with the sliding cam 7*e* of the second slide element 7. Here, the in each case non-actuated slide element passes out of engagement with the sliding face 8*b* of the lever 8*a*, so that said slide element is closed on account of the above-described spring forces.

An actuator (not illustrated) is embodied in the form of a linear hydraulic force introduction unit. By means of the actuator, it is possible for the lever 8*a* to be moved in a driving fashion in the one or the other direction, as a result of which either the first slide element 6 or the second slide element 7 is actuated in the opening direction. When the first slide element 6 is actuated in the opening direction, the chambers 2*a*, 2*b* which supply the exhaust gas are connected via the connections 4*b*, 4*c* in each case to the chamber 4*a*. Here, the port 4 leads to an exhaust gas cooler of the recirculated exhaust gas. With a correspondingly oppositely directed actuation of the lever 8*a*, the second slide element 7 is actuated in the opening direction, with the ducts 2*a*, 2*b* being connected to the duct 3*a* by means of the connections 3*b*, 3*c*. The duct 3*a* is connected by means of the port 3 to a bypass line which bypasses the exhaust gas cooler in parallel.

Overall, therefore, it is possible by means of a one-dimensional adjustment of a single actuator both to make a selection as to whether an exhaust gas stream is connected to the exhaust gas cooler or the bypass line, and also to ensure the dosing of the recirculated exhaust gas. Here, the valve plates 4*b*, 4*c*, 3*b*, 3*c* can be at least partially conical in shape and if appropriate held in corresponding cup-shaped valve seats in order to permit yet more precise dosing of the recirculated exhaust gas stream.

Figure 2:
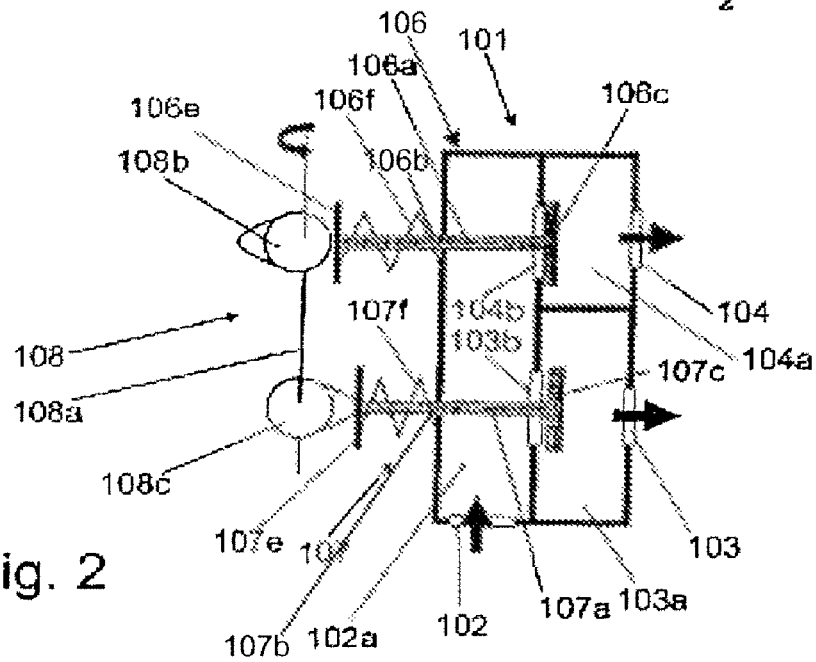
FIG. 2 shows a schematic sectioned view of a second exemplary embodiment of a device according to the invention.

The second exemplary embodiment as per FIG. 2, in contrast to the first exemplary embodiment, has only a single supplying chamber 102*a* with one port 102. The supplying chamber 102*a* is connected by means of a first connecting opening 103*b* to a chamber 103*a* of a second port 103, and by means of a connecting opening 104*b* to a chamber 104*a* of a third port 104. Similarly to the first exemplary embodiment, a first slide element 106 and a second slide element 107 are provided. On account of the simplified design of the housing 101 with only in each case one connection 103*b*, 104*b* between the inlet line 102*a* and the two outlet lines 103*a*, 104*a*, each of the slide elements 106, 107 has only one valve plate 106*c*, 107*c* which is fixed in each case to the end of a corresponding slide rod 106*a*, 107*a*. As in the first exemplary embodiment, the two slide rods 106*a*, 107*a* are guided in openings 106*b*, 107*b* of the housing 101 and are acted on with force in the closing direction by means of springs 106*f*, 107*f*. Situated at the end sides of the slide rods 106*a*, 107*a* are sliding faces 106*e*, 107*e*. The control mechanism 108 of the second exemplary embodiment comprises a rotatable shaft 108*a* which runs perpendicularly to the slide rods 106*a* and 107*a* and has cam-like eccentric elements 108*b*, 108*c* in each case at the level of the sliding faces 106*e*, 107*e*. The eccentric elements 108*b*, 108*c* are substantially identical in shape but are fixed to the shaft 108 so as to be offset with respect to one another by a rotational angle of 180°.

In the rotational position of the shaft 108*a* as per FIG. 2, the one eccentric 108*b* engages on the sliding face 107*e* situated opposite it in such a way that the slide rod 107*a* is pressed in to a maximum extent in the opening direction counter to the spring force and the slide element 107 is open. The other eccentric 108*b*, in contrast, does not engage on the sliding face 106*e* of the first slide element 106, so that the first slide element 106 is closed on account of the spring force. As can be seen, the cams 108*b*, 108*c* are shaped to be so steep that there is a position of the rotary shaft 108*a* in which neither of the slide elements 106, 107 is open. On account of the shaping of the flanks of the cams, an only partial opening of a slide element 106, 107 is also possible depending on the rotational position, with the in each case other slide element being closed.

An actuator (not illustrated) is embodied in the manner of an electric motor and is if appropriate connected by means of a step-up transmission to the rotary shaft 108*a*. Said actuator can however also be a linear hydraulic cylinder which transmits a linear movement into the rotational movement of the rotary shaft 108*a* for example by means of a toothed rack and a pinion.

It is self-evident that the components, in particular the control mechanisms 8, 108 of the first and second exemplary embodiments are interchangeable. It is thus for example possible for only one of the slide elements to be of two-stage design. It is likewise possible for the arrangement of the closure elements to be acted on by the exhaust gas pressure in the closing direction or in the opening direction depending on the arrangement.

The invention claimed is:

1. A device for controlling an exhaust gas stream, comprising a housing with at least one first, one second and one third port for connecting to a first, a second and a third exhaust gas duct for conducting exhaust gases of an internal combustion engine, a first slide element including a movable first slide rod, a first closure element and a sliding face;

a second slide element including a movable second slide rod, a second closure element and a sliding face;

an actuator for the power-assisted actuation of the device;

a connection between the first and the second port configured to be closed off in an adjustable fashion by the first closure element;

a connection between the first and the third port configured to be closed off in an adjustable fashion by the second closure element; and a control mechanism, connected to the actuator and spaced from the first slide element and the second slide element, wherein the control mechanism is configured to engage at least one of the sliding face of the first slide element and the sliding face of the second slide element.

2. The device as claimed in claim 1, wherein one of the at least three ports is connected to an exhaust line, to an exhaust gas cooler and to an exhaust gas line of the exhaust gas cooler.

3. The device as claimed in claim 1, wherein at least the first slide element can be acted on with force in a closing direction by a spring.

4. The device as claimed in claim 1, wherein the exhaust gas stream exerts a pressure in a opening direction on at least the first closure element.

5. The device as claimed in claim 1, wherein a further closure element which is movable with respect to the first closure element is provided on at least the first slide element, with the closure elements, during the course of an opening movement of the slide element, releasing in succession openings which are assigned to said closure elements.

6. The device as claimed in claim 1, wherein the control mechanism comprises at least one rotatably mounted lever.

7. The device as claimed in claim 1, wherein the control mechanism comprises a rotatable shaft with an eccentric element.

8. The device as claimed in claim 1, wherein the control mechanism comprises a slotted guide disk.

9. The device as claimed in claim 1, wherein the actuator comprises a linear, drive unit.

10. The device as claimed in claim 1, wherein at least the first closure element is of plate-shaped design.

11. The device as claimed in claim 1, wherein at least the first closure element is of conical design.

12. The device as claimed in claim 1, wherein at least the first closure element comprises a rotatable actuating flap.

13. The device as claimed in claim 9, wherein the linear drive unit is a hydraulic drive unit.

14. The device as claimed in claim 1, wherein the actuator comprises a rotary drive unit.

15. The device as claimed in claim 14, wherein the rotary drive unit is an electromotive drive unit.

* * * * *